US006821391B2

(12) United States Patent
Scherb et al.

(10) Patent No.: US 6,821,391 B2
(45) Date of Patent: Nov. 23, 2004

(54) FORMER AND PROCESS FOR PRODUCING A TISSUE WEB

(75) Inventors: Thomas Thoröe Scherb, Sao Paulo (BR); Harald Schmidt-Hebbel, Barueri (BR)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/769,275

(22) Filed: Jan. 26, 2001

(65) Prior Publication Data

US 2001/0013399 A1 Aug. 16, 2001

(30) Foreign Application Priority Data

Jan. 28, 2000 (DE) ..... 100 03 685

(51) Int. Cl.[7] ..... B31F 1/12; D21G 3/04

(52) U.S. Cl. ..... 162/280; 162/300; 162/305; 162/309; 162/281; 162/358.1; 162/358.3; 162/358.5; 162/361; 162/290; 162/359.1; 162/111; 162/112

(58) Field of Search ..... 162/300, 305, 162/309, 280, 281, 358.1, 358.3, 358.5, 361, 111, 112, 290, 359.1

(56) References Cited

U.S. PATENT DOCUMENTS

| | | | | |
|---|---|---|---|---|
| 5,306,395 A | | 4/1994 | Myrén | |
| 5,397,437 A | | 3/1995 | Myrén | |
| 5,517,714 A | | 5/1996 | Kotitschke | |
| 5,527,428 A | | 6/1996 | Trokhan et al. | |
| 5,534,326 A | | 7/1996 | Trokhan et al. | |
| 5,536,372 A | * | 7/1996 | Odell et al. | 162/203 |
| 5,654,076 A | | 8/1997 | Trokhan et al. | |
| 5,783,044 A | | 7/1998 | Schneider et al. | |
| 6,136,146 A | | 10/2000 | Phan et al. | |
| 6,203,663 B1 | | 3/2001 | Kamps et al. | |
| 6,231,723 B1 | * | 5/2001 | Kanitz et al. | 162/280 |
| 6,235,160 B1 | * | 5/2001 | Tietz et al. | 162/358.5 |

FOREIGN PATENT DOCUMENTS

| | | | | |
|---|---|---|---|---|
| DE | 4327601 | | 1/1995 | |
| DE | 19732879 | | 2/1999 | |
| DE | 197 56 422 | * | 6/1999 | D21F/11/14 |
| EP | 0731212 | | 9/1996 | |
| SE | 427053 | | 2/1983 | |
| SE | 8202627-9 | | 2/1983 | |
| WO | 94/28242 | | 12/1994 | |
| WO | 96/35018 | | 11/1996 | |
| WO | 99/06629 | | 2/1999 | |
| WO | 00/12817 | | 3/2000 | |

OTHER PUBLICATIONS

U.S. patent application No. 09/769,462, filed Jan. 26, 2001.
U.S. patent application No. 09/769,464, Filed Jan. 26, 2001.

* cited by examiner

*Primary Examiner*—Peter Chin
*Assistant Examiner*—Mark Halpern
(74) *Attorney, Agent, or Firm*—Greenblum & Bernstein, P.L.C.

(57) ABSTRACT

A former for producing a tissue web and a process of making a tissue web using the former. The former includes a forming element, an inner dewatering belt, and an outer dewatering belt. The inner and outer belts converge to form a stock inlet nip. The inner and outer belts are guided over the forming element and thereafter separating from one another in the area of a separation point. At least one suction element is positioned adjacent the inner belt on a side which is opposite the outer belt. Alternatively, a conditioning device is positioned adjacent the outer belt. The process includes forming the tissue web in the area of the forming element, guiding the inner and outer belts around the forming element, and separating the inner and outer belts in the area of the separation point. Alternatively, the process includes conditioning the outer belt.

46 Claims, 7 Drawing Sheets

FORMER AND PROCESS FOR PRODUCING A TISSUE WEB

CROSS-REFERENCE TO RELATED APPLICATIONS

The present application claims priority under 35 U.S.C. §119 of German Patent Application No. 100 03 685.6, filed on Jan. 28, 2000, the disclosure of which is expressly incorporated by reference herein in its entirety.

BACKGROUND OF THE INVENTION

1. Field of the Invention

The invention relates to a former of a machine for producing a tissue web containing two circulating continuous dewatering belts that converge to form a stock inlet nip and which are guided subsequently over a forming element such as, e.g., a forming roll. The invention also relates to a process of making a tissue web using such a former.

2. Discussion of Background Information

Double wire formers and crescent formers are typically used for the production of tissues or tissue webs. In this way, a fibrous suspension is introduced between two dewatering belts which are guided over at least a part of the circumference of a forming roll. In the case of double wire formers, the two dewatering belts are embodied as dewatering wires. In the case of crescent formers, however, a felt belt is provided as the inner wire while outer belt is an outer wire.

Arranged behind the forming roll when viewed in the flow direction, the outer belt is guided away from the inner belt. The tissue web formed between the two dewatering belts separates from the upper dewatering belt and travels along with the lower dewatering belt. However, this separation process causes problems when the outer belt is very rough and/or very open. Such problems can even occur when the wire is one with a zonally variable wire permeability, i.e., a so-called DSP wire. Apparently, the dewatering flow partially pulls the fibers into the dewatering belt, where they interlock. This is disadvantageous since the tissue web may undesirably tend to travel along with the outer wire. Furthermore, it is also disadvantageous because the fibers, which are interlocked with the outer wire, are not completely removed together with the tissue web from the rough open outer wire during the separation process, but instead partially remain in the outer wire, i.e., undesirably stuck to the outer wire. During operation, this incomplete separation problem between the fibers and the outer wire leads to an increasing contamination of the outer wire, and thus to a loss of quality in the web being produced. Runability problems can also occur in the tissue machine as a result or incomplete separation.

SUMMARY OF THE INVENTION

The invention therefore provides a former as well as a process of the type mentioned at the outset that ensures a reliable and secure operation of a tissue machine containing a DSP wire in its initial dewatering section.

Accordingly, the invention provides for a former which utilizes a dewatering wire with zonally variable wire permeability that is provided as the outer belt. This outer wire does not come into contact with the forming element. Further, in the area of a separation point, wherein this outer belt and the inner belt are separated from one another, a suction element is provided inside the loop of the inner belt. The forming element may itself be the suction element by being provided with a suction zone and/or the suction element may be positioned downstream from the forming element.

By utilizing a suction element, the tissue web can be securely lifted off the outer wire. In this regard, a suction box with edges and suction slits, a suction roll, and/or a suction pipe, for example, may be used as a suction element.

Wires having zonally variable permeability are known, e.g., as disclosed in Swedish Patent SE 427 053 which is expressly incorporated by reference in its entirety. According to this document, such wires can be formed as, e.g., a woven material in which longitudinal and lateral threads are provided on one or more levels, i.e., woven together according to a predetermined pattern such that systematically distributed areas of suitable size develop in which the number of overlapping points equals zero or is significantly smaller than in the woven structure of the remaining woven material.

According to one embodiment of the former according to the invention, the vacuum provided in the suction element is adjustable. Thus, a problem-free adjustment of each operational condition (basis weight, porosity of the web, speed) is possible.

The suction element is suitably positioned, in the web travel direction, in front of the separation point.

The separation of the two webs can occur, for instance, in the area of and/or on the suction element.

The suction element may also be advantageously embodied such that it affects the inner belt at least essentially over its entire width.

The suction element may accordingly be provided with, for instance, suction apertures which are positioned such that the tissue web reaches the suction zone before the dewatering belts are separated. Further, the suction apertures may have the form of, for instance, one or more suction slits which are as wide as the machine or several rows of apertures consecutively positioned in the web travel direction and offset in relation to each other (e.g., round holes, oblong holes, etc).

In order to improve or support the effective separation of the suction elements, a blowing element may also be provided in the area of the separation point, e.g., positioned inside the loop of the outer belt. This blowing element may suitably be embodied such that it affects the outer belt at least essentially over its entire width. The blowing medium may be water, air, or the like; however air is a preferred medium.

According to another embodiment, the forming element is provided with a suction zone in which a corresponding vacuum is preferably adjustable. Using the adjustable vacuum allows for the contact intensity between the tissue web and the inner belt to be modified and/or adjusted. By utilizing an increased vacuum, for instance, the adhesion of the web to the outer belt can be reduced. Moreover, this acts to increase the adhesion between the tissue web and the inner belt, which improves the separation accordingly.

According to another aspect of the invention, the former includes at least one of the two dewatering belts which is embodied as a dewatering belt with zonally variable wire permeability, i.e., a DSP wire and a conditioning device which may be a wire cleaning device. The conditioning device being assigned to such a dewatering wire. This design counteracts the tendency for contamination of the DSP wire, which is based on fibers invading the volume of the wire and sticking due to its variable permeability. Moreover, this design reduces corresponding contamination of the wire, which affects the performance of the wire, and thus the quality of the tissue web. Thus, the disadvantages which occur because of contamination are avoided by the conditioning device and/or wire cleaning device according to the invention. According to one embodiment, the conditioning device may have the form of, for instance, spray pipes having jets provided over the width of the machine. A traversing conditioning device may also be used, e.g., a "Duocleaner" (cf. EP-O 731 212 A) made by the company Voith Sulzer and having both rotating high pressurized jets and integrated suctioning. A "Jet Cleaner" made by the company Voith Sulzer, for instance, may also be used. U.S. Pat. No. 5,783,044 illustrates a "Duocleaner" which may be used; this document being expressly incorporated by reference in its entirety.

The conditioning device is preferably embodied such that it affects the dewatering belt at least essentially over its entire width. Moreover, a cleaning device operating accordingly over the entire width (e.g., spray pipes with jets positioned over the width of the machine, Jet Cleaner, cleaning roll, etc) can be used in combination with a traversing locally intense operating cleaning device (e.g., Duocleaner, high pressure jet). By combining such cleaning elements, wire wear can be minimized at the same time that sufficiently good cleaning effects are maintained.

According to another embodiment, the corresponding former is embodied as a crescent former in which the inner belt is provided as a felt belt.

According to one embodiment of the process according to the invention, a dewatering belt having zonally variable wire permeability is used as the outer belt, wherein this outer belt does not come into contact with the forming element. Additionally, the outer belt and the inner belt are separated from one another in the area of the separation point. Moreover, the inner belt is suctioned by one or more suction elements provided inside its loop; and/or the forming element is provided with a suction zone and acts as the suction element.

This design acts to counteract the tendency for contamination of the corresponding DSP wire.

Advantageous embodiments of the process according to the invention may be as follows: the inner belt may be suctioned in the web travel direction in front of the separation point; the inner belt may be suctioned at least essentially over its entire width; the outer belt may be affected by a blowing element positioned inside its loop in the area of the separation point; and the outer belt may be affected by a blowing element at least essentially over its entire width.

According to one embodiment, the process according to the invention is used advantageously in a crescent former.

Moreover, wires of the type described in WO 00/12817 (application No. PCT/GB99/02684) which is expressly incorporated by reference in its entirety, for example, can be used as wires having the zonally variable permeability. The correlating wires can particularly comprise a woven material in which threads provided in one or several levels and running in the one direction are woven with threads running in another direction, such that a mesh results that separates a multitude of systematically distributed areas of predeterminable configurations and accordingly determines with the systematically distributed areas each containing three threads running in the one direction and at least three running in the other. In particular, the threads can be woof threads and warp threads.

The invention therefore provides a former for producing a tissue web, comprising a forming element, an inner dewatering belt, and an outer dewatering belt, the inner and outer belts converging to form a stock inlet nip, the inner and outer belts being guided over the forming element and thereafter separating from one another in the area of a separation point, and at least one suction element positioned adjacent the inner belt on a side which is opposite the outer belt.

At least the outer belt may be a dewatering wire having zonally variable wire permeability. The tissue web may be separated from the outer belt in the area of the separation point. The tissue web may be retained by the inner wire after being separated from the outer belt. At least one of the inner and outer belts may comprise a circulating continuous dewatering belt. The forming element may comprise a forming roll. Each of the inner and outer belts may be a circulating continuous dewatering wire having zonally variable wire permeability. The inner belt may contact the forming element and the outer belt may be guided with the inner belt around the forming element such that the outer belt does not come into contact with the forming element. The forming element may comprise the at least one suction element. The forming element may comprises a suction zone. The at least one suction element may be positioned adjacent the area of the separation point. The at least one suction element may be provided inside a loop of the inner belt. The at least one suction element may comprise a vacuum suction element and wherein the vacuum present inside the suction element is adjustable. The at least one suction element is positioned in front of the separation point, in a web travel direction. The at least one suction element may cause the inner belt to separate from the outer belt. The at least one suction element may be arranged at least essentially over an entire width of one of the inner belt and the tissue web. The former may further comprise at least one blowing element positioned adjacent the outer belt on a side which is opposite the inner belt. The at least one blowing element may be located in the area of the separation point. The at least one blowing element may be located in the area of the separation point and inside a loop of the outer belt. The at least one blowing element may be arranged at least essentially over an entire width of one of the outer belt and the tissue web. The forming element may comprise a suction zone having adjustable vacuum.

The invention also provides for a former for producing a tissue web, comprising a forming element, an inner dewatering belt, and an outer dewatering belt, the inner and outer belts converging to form a stock inlet nip, the inner and outer belts being guided over the forming element and thereafter separating from one another in the area of a separation point, and a conditioning device positioned adjacent the outer belt.

At least one of the inner belt and the outer belt may be a dewatering wire having zonally variable wire permeability. The former may further comprise at least one suction element positioned adjacent the inner belt on a side which is opposite the outer belt. The tissue web may be separated from the outer belt in the area of the separation point. The tissue web may be retained by the inner wire after being separated from the outer belt. At least one of the inner and outer belts may comprise a circulating continuous dewatering belt. The forming element may comprise a forming roll. Each of the inner and outer belts may be a circulating continuous dewatering wire having zonally variable wire permeability. The inner belt may contact the forming element and the outer belt may be guided with the inner belt around the forming element such that the outer belt does not come into contact with the forming element. The forming element may comprise the at least one suction element. The forming element may comprise a suction zone. The former may further comprise at least one suction element positioned adjacent the area of the separation point. The at least one suction element may be provided inside a loop of the inner belt. The at least one suction element may comprise a vacuum suction element and wherein the vacuum present inside the suction element is adjustable. The at least one suction element may be positioned in front of the separation point, in a web travel direction. The at least one suction element may cause the inner belt to separate from the outer belt. The at least one suction element may be arranged at least essentially over an entire width of one of the inner belt and the tissue web. The former may further comprise at least one blowing element positioned adjacent the outer belt on a side which is opposite the inner belt. The at least one blowing element may be located in the area of the separation point. The at least one blowing element may be located in the area of the separation point and inside a loop of the outer belt. The at least one blowing element may be arranged at least essentially over an entire width of one of the outer belt and the tissue web. The forming element may comprise a suction zone having adjustable vacuum. The conditioning device may comprise a wire cleaning device. The conditioning device may be arranged at least essentially over an entire width of one of the outer belt and the tissue web. The inner belt may be a felt belt. The former may be a crescent former.

The invention also contemplates a process for producing a tissue web in a former which includes a forming element, an inner dewatering belt, and an outer dewatering belt, the inner and outer belts converging to form a stock inlet nip, the inner and outer belts being guided over the forming element and thereafter separating from one another in the area of a separation point, and at least one suction element positioned adjacent the inner belt on a side which is opposite the outer belt, the process comprising forming the tissue web in the area of the forming element, guiding the inner and outer belts around the forming element, and separating the inner and outer belts in the area of the separation point.

The separating may comprise separating the outer belt from the inner belt. The separating may comprise suctioning the inner belt via the at least one suction element which is positioned inside a loop. The separating may comprise suctioning the inner belt via the forming element, the forming element comprising the at least one suction element having a suction zone. The separating may comprise suctioning the inner belt in front of the separation point, in the web travel direction. The separating may comprise suctioning the inner belt via the at least one suction element arranged at least essentially over an entire width of one of the tissue web and the inner belt. The process may further comprise blowing a medium against the outer belt using a blowing element positioned adjacent the outer belt in the area of the separation point. The blowing may comprise blowing a medium against the outer belt via the at least one blowing element arranged at least essentially over an entire width of one of the tissue web and the outer belt. The blowing element may be positioned inside a loop of the outer belt in the area of the separation point.

There is also provided a process for producing a tissue web in a former which includes a forming element, an inner dewatering belt, and an outer dewatering belt, the inner and outer belts converging to form a stock inlet nip, the inner and outer belts being guided over the forming element and thereafter separating from one another in the area of a separation point, and a conditioning device positioned adjacent the outer belt, the process comprising forming the tissue web in the area of the forming element, guiding the inner and outer belts around the forming element, and conditioning the outer belt.

The process may further comprise separating the inner and outer belts in the area of the separation point. The separating may comprise separating the outer belt from the inner belt. The separating may comprise suctioning the inner belt via the at least one suction element which is positioned inside a loop. The separating may comprise suctioning the inner belt via the forming element, the forming element comprising the at least one suction element having a suction zone. The separating may comprise suctioning the inner belt in front of the separation point, in the web travel direction. The separating may comprise suctioning the inner belt via the at least one suction element arranged at least essentially over an entire width of one of the tissue web and the inner belt. The process may further comprise blowing a medium against the outer belt using a blowing element positioned adjacent the outer belt in the area of the separation point. The blowing may comprise blowing a medium against the outer belt via the at least one blowing element arranged at least essentially over an entire width of one of the tissue web and the outer belt. The blowing element may be positioned inside a loop of the outer belt in the area of the separation point. The former may comprise a crescent former in which the inner belt is a felt belt. The at least the outer belt may be a dewatering wire having zonally variable wire permeability.

The invention farther provides for a former for producing a tissue web, comprising a forming roll, an inner continuous dewatering belt, and an outer continuous dewatering belt, the inner and outer belts converging to form a stock inlet nip, a headbox positioned adjacent the stock inlet nip, each of the inner and outer belts forming corresponding inner and outer continuous loops which are each guided over a plurality of guide rolls, each of the inner and outer belts being guided over the forming roll and thereafter separating from one another in the area of a separation point, and one of at least one suction element positioned inside the inner loop and adjacent the inner belt on a side which is opposite the outer belt and a conditioning device positioned adjacent so as to clean the outer belt, wherein at least one of the inner and the outer belts is a dewatering wire having zonally variable wire permeability.

The former may further comprise a press nip through which the tissue web and the inner belt is guided, the press nip being formed between a cylinder and shoe press roll, wherein the tissue web is removed from the inner belt after passing through the press nip.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
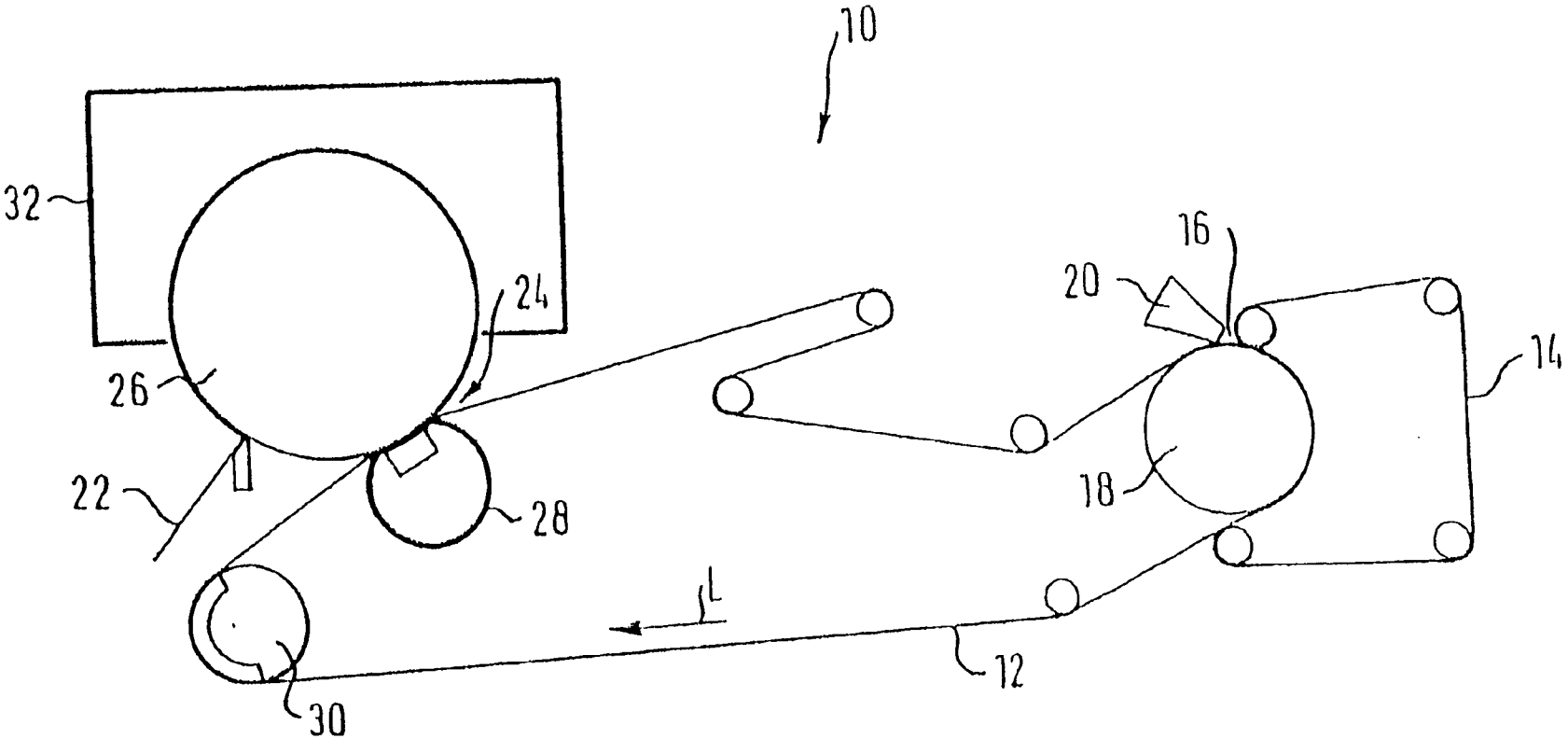
FIG. 1 shows a schematic representation of a crescent former with a shoe press provided at the Yankee cylinder.

FIG. 1 shows in schematic representation a crescent former 10 of a machine for producing a tissue web 22. Two circulating continuous dewatering belts 12 and 14 are provided and arranged to converge so as to form a stock inlet nip 16. Belts 12 and 14 are subsequently guided over a forming element which may have the form of a forming roll 18.

In operation, a fibrous stock suspension is introduced into stock inlet nip 16 via a headbox 20.

A dewatering wire having zonally variable wire permeability, e.g., such as a so-called DSP wire, is provided as outer belt 14. This outer belt 14 is arranged so that it does not contact forming roll 18. Inner belt 12 is arranged to contact forming roll 18 and may be a felt belt in the present exemplary embodiment.

After exiting forming roll 18, the formed tissue web 22 passes together with inner belt 12, into an press nip 24 which may be an elongated press nip. Press nip 24 may be formed between a tissue dewatering cylinder 26, e.g., a Yankee cylinder, and a shoe press unit 28, e.g., such as a shoe press roll. Arranged before the press nip 24, in the web travel direction L, is positioned a suction device 30. Inner belt 12, which serves to guide tissue web 22, is also guided over suctioned device 30, e.g., in the form of a suction roll.

A drying cover 32 can also be provided with Yankee cylinder 26.

Figure 2:
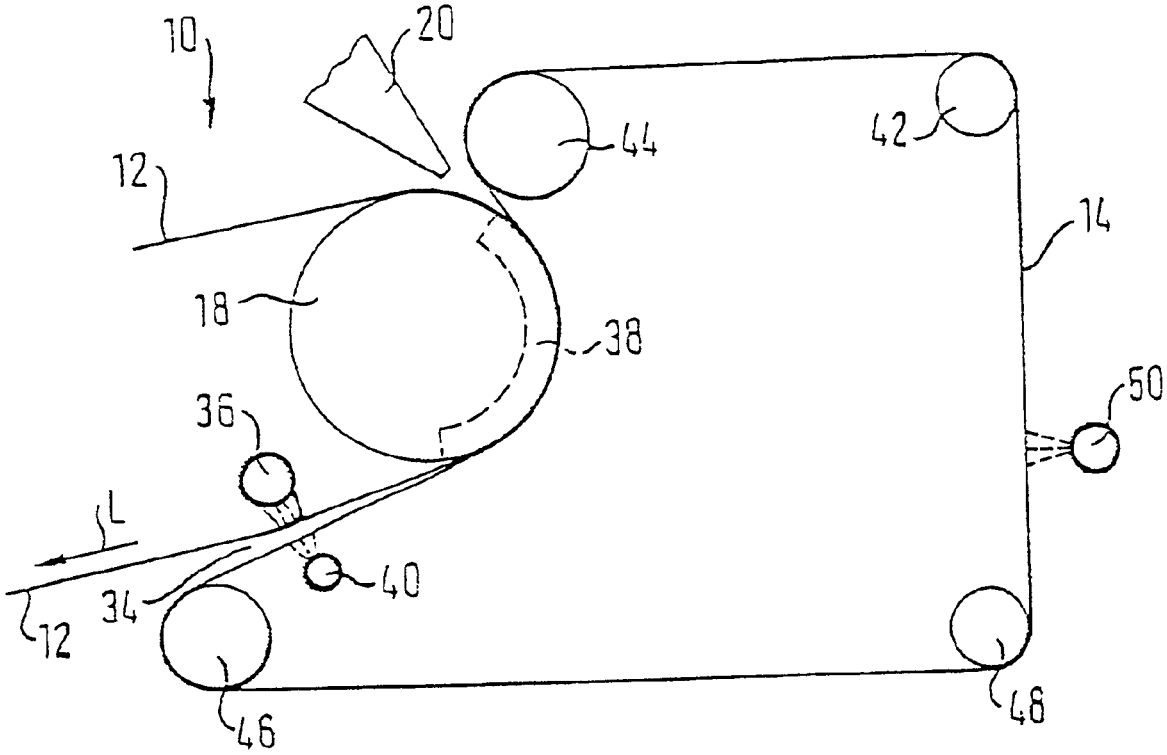
FIG. 2 shows an enlarged representation of the forming zone of the former depicted in FIG. 1 with the suction element provided inside the loop of the inner belt and the conditioning device assigned to the outer wire.

FIG. 2 illustrates an enlarged representation of the forming zone of the former shown in FIG. 1, in which the essential details of the arrangement according to the invention are discernible.

The former utilizes at least one suction element 36 which is positioned inside the loop of inner belt 12, in the area of separation point 34. Separation point 34 is a position where outer wire 14 and inner belt 12 are separated from each other. Alternatively or additionally, forming roll 18 can be provided with a suction zone 38. With such a suctioned forming roll 18, the fibrous web is pulled against inner belt 12 which can be a felt belt.

In the embodiment shown, suction element 36 is located, in the web travel direction L, in the area of separation point 34, e.g., in this case positioned in front of separation point 34. The vacuum present in suction element 36 can be adjustable. This can also be the case for the vacuum of suction zone 38. Moreover, each device may have its vacuum adjusted by an independent mechanism, e.g., such that each device is independently adjusted, or by a common mechanism which controls vacuum to both devices. Additionally, suction elements 36 or 38 can be embodied such that they affect inner belt 12 at least essentially over its entire width.

In the area of separation point 34, at least one blowing element 40 can also be provided inside the loop of outer wire 14. As a result, outer wire 14 can be impacted from the inside with a medium, for instance, such as blowing air. Blowing element 40 can be suitably embodied such that it affects outer wire 14 at least essentially over its entire width.

Outer wire 14 can be guided over suitably arranged guide rolls 42, 44, 46 and 48. Moreover, outer wire 14 may be arranged with a conditioning device 50 which can particularly be a wire cleaning device. Conditioning device 50 is suitably embodied such that it affects outer wire 14 at least essentially over its entire width.

Conditioning device 50 may include a spray pipe, for instance, such as a "Duocleaner" made by the company Voith Sulzer, a roll having a scraper inserted into the corresponding dewatering wire, and/or the like.

Figure 3:
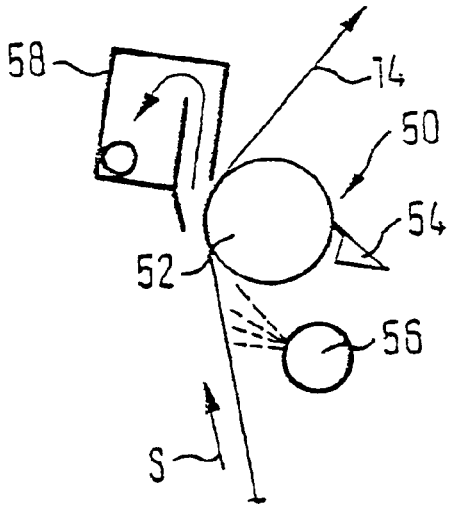
FIG. 3 shows a schematic representation of a conditioning device assigned to the outer wire of the former which contains a roll and a scraper inserted into the dewatering wire.

FIG. 3 illustrates a schematic representation of one embodiment of a conditioning device 50 which is assigned to a corresponding dewatering wire, in this case, outer wire 14. Outer wire 14 is embodied with a zonally variable wire permeability. Conditioning device 50 also includes a roll 52 and a scraper 54 assigned thereto which is inserted into outer wire 14. Arranged in the belt travel direction S and in front of roll 52, is a spray pipe 56 which is positioned on the same side of outer wire 14 as roll 52. Any contaminated water and the like which exits from outer wire 14 is accepted by an accepting device 58 which is provided on the other side of outer wire 14.

In the exemplary embodiment depicted in FIG. 2, conditioning device 50 is positioned between guiding rolls 42 and 48. However, conditioning device 50 may also be positioned in the area of other guide rolls and, for instance, in the area adjacent guide roll 42 (cf. FIGS. 4 through 6).

Figure 4:
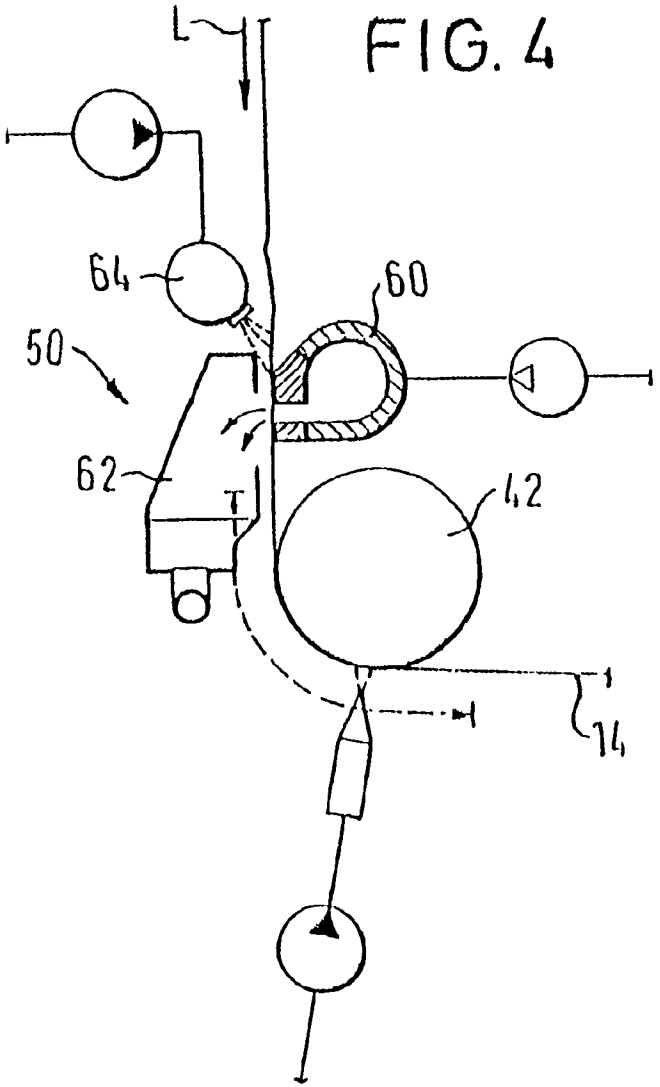
FIG. 4 shows a schematic representation of a conditioning device positioned in the area of a guiding roll of the outer wire that is of the "Jet Cleaner" type.

FIG. 4 illustrates a schematic representation of a conditioning device 50 positioned in the area of a guiding roll, for instance, guiding roll 42. This embodiment of condition device 50 is formed, e.g., by a "Jet Cleaner" made by the company Voith Sulzer. Conditioning device 50 includes a jet arrangement 60 which is positioned inside the loop of outer wire 14. Arranged to affect outer wire 14, is a suction device 62 which is positioned opposite from jet arrangement 60 on the other side of outer wire 14. A spraying pipe 64 is also positioned in front of suction device 62, in the web travel direction L, in order to affect the outside of outer wire 14. In the present embodiment, jet arrangement 60 is positioned in front of guiding roll 42, in the web travel direction L, and is preferably positioned at a distance from guiding roll 42.

Figure 5:
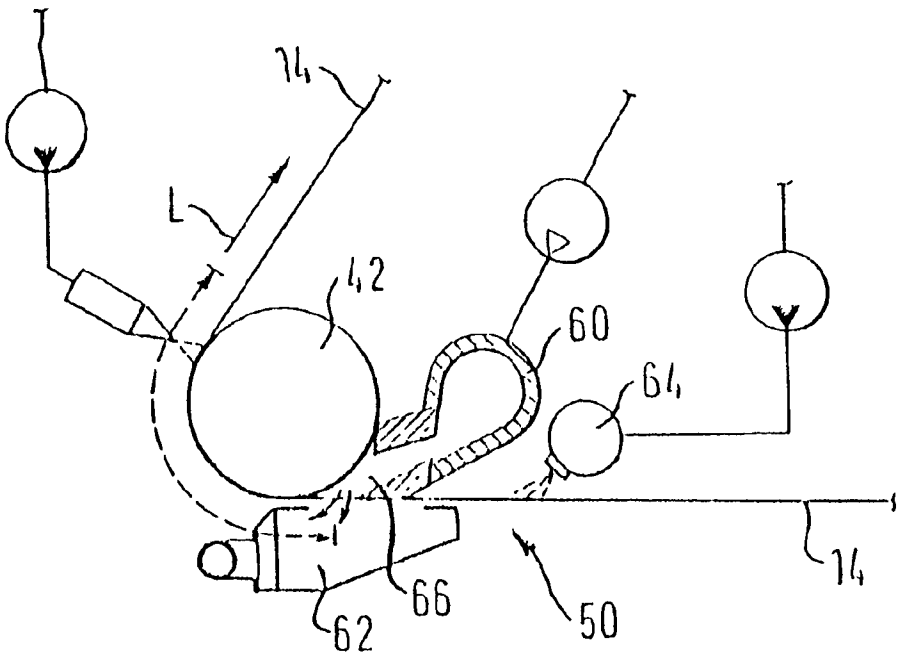
FIG. 5 shows a schematic representation of another embodiment of a conditioning device positioned in the area of a guiding roll of the outer wire that is of another "Jet Cleaner" type.

FIG. 5 shows another embodiment of conditioning device 50 according to an arrangement comparable to FIG. 4, but wherein jet arrangement 60 is positioned in an inlet wedge 66 which is formed between outer wire 14 and guiding roll 42. In the present case, a wrapping angle (indicated by a curved dashed line) indicating the amount of the circumference of guiding roll 42 which is wrapped by outer wire 14, is made larger than in the arrangement depicted in FIG. 4. Moreover, conditioning device 50 also includes similar parts as those of FIG. 4, with the same reference characters being assigned to corresponding elements.

Figure 6:
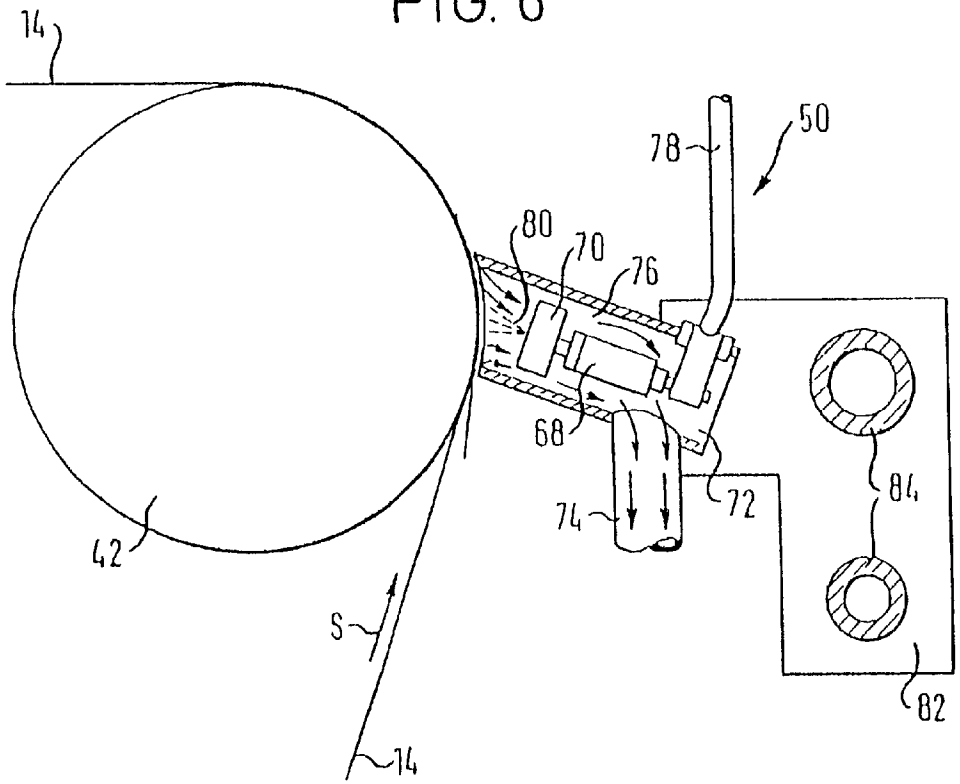
FIG. 6 shows a schematic representation of a conditioning device positioned in the area of a guiding roll of the outer wire which is of a "Duocleaner" type.

FIG. 6 shows a schematic representation of another embodiment of a conditioning device 50 which is positioned in the area of a guiding roll, for instance, guiding roll 42. In this embodiment, conditioning device 50 is formed, e.g., by a "Duocleaner" which is made by the company Voith Sulzer.

In this arrangement, conditioning device 50 is a cleaning device which is located in the area of guiding roll, for instance, guiding roll 42. A cleaning jet 68 is utilized in the form of a rotor jet having a jet head 70 which can rotate. A jet arrangement that is not depicted in detail is also provided in this embodiment. A suction cup 72 in the shape of a cylinder surrounds cleaning jet 68 and jet head 70. The inside of suction cup 72 is connected to a suction pipe 74 to allow for dynamic flow (indicated by flow arrows) and forms a suction area 76 which at cleaning jet 68. Further, cleaning jet 68 may be supplied with fluid via a high pressurized pipe 78. Accordingly, with this design, outer wire 14 can be exposed to a rotating high pressurized water jet 80, for instance, such that the removal of contaminants and water by suction occurs by way of suction pipe 74.

The above-mentioned parts of conditioning device 50 may be positioned on a traversing wagon 82 which is shiftable laterally to the web travel direction L. In this regard, traversing wagon 82 rests on lateral carriers 84 which can be driven by a traversing motor, which is not depicted in detail.

Otherwise, this conditioning device 50 can be embodied, for instance, as described in EP-0 731 212 A and/or U.S. Pat. No. 5,783,044.

Inner and/or outer wires made have a design similar to that described in WO 00/12817 (application PCT/GB99/02684), for example, they can be used as wires with a variable permeability. According to this configuration, the wires in question can be made, in particular, of a woven material in which threads, provided on one or more levels running in a first direction, are interwoven with threads running in a second direction such that a grid results which separates a multitude of systematically distributed areas of predeterminable configurations and fixes them accordingly. The systematically distributed areas may have at least three threads running in the one direction and at least three in the other. The threads can particularly be woof threads and warp threads.

Figure 7:
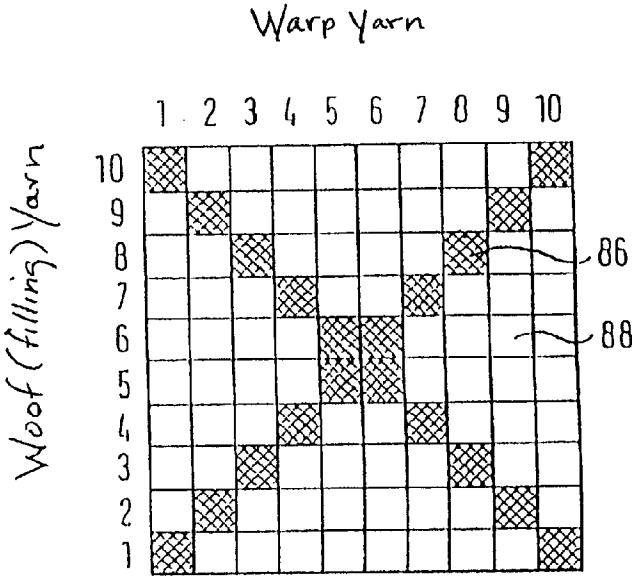
FIG. 7 shows a diagram of a weaving pattern of the possible embodiment of a repeating section of a dewatering wire with zonally variable permeability formed by a woven material.

FIG. 7 depicts one possible example of a diagram of a weaving pattern. In particular, a section of a possible embodiment of such a woven material repeating itself is shown which forms a dewatering wire with zonally variable wire permeability. In the present exemplary embodiment, the repeating diagram of a weaving pattern contains ten woof threads and ten warp threads. In the area of the shaded squares, the woof thread is positioned beneath the warp thread. However, in the area of the light squares the woof thread is positioned above the warp thread. Depending on the prevailing conditions, the one or the other side of the diagram of the weaving pattern can be on the outside.

The shaded areas form a grid 86 by which finally a multitude of systematically distributed areas 88 of a predetermined configuration are separated from one another and are fixed accordingly.

Figure 8:
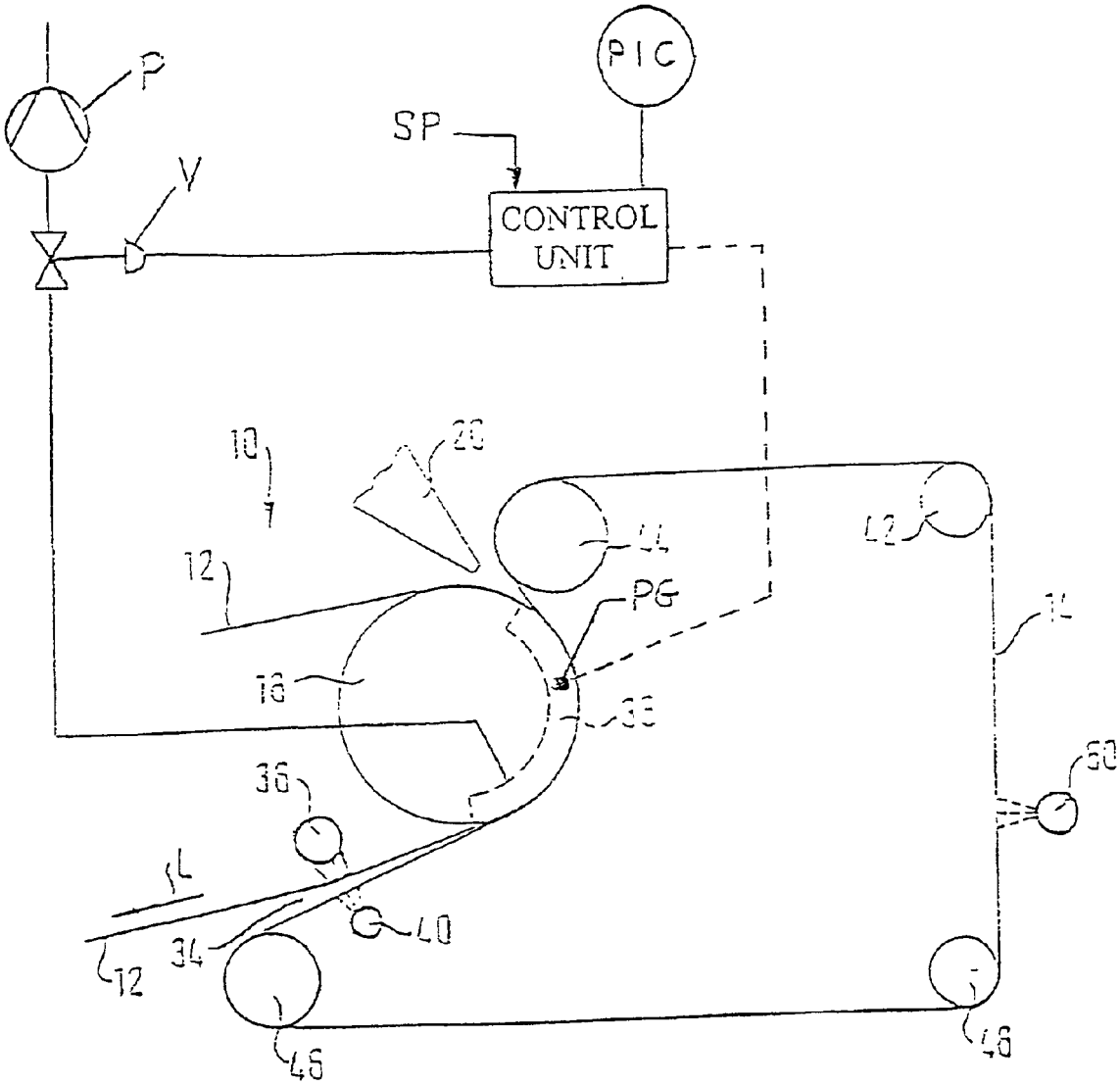
FIG. 8 shows an enlarged representation of the forming zone of the former depicted in FIG. 1 and illustrates one embodiment of how the vacuum to the suction zone is regulated or controlled.

FIG. 8 shows an enlarged representation of the forming zone of the former depicted in FIG. 1 and illustrates one embodiment of how the vacuum to the suction zone is regulated or controlled.

The former utilizes regulated, controlled and/or adjustable vacuum to suction zone 38 which is positioned inside the loop of inner belt 12, in the area of forming roll 18. A vacuum device P which may be a vacuum pump or an exhaust fan or similar vacuum source is connected to suction zone 38 to supply vacuum thereto. A valve V which may be a throttling device or a butterfly valve or the like is position in between the vacuum device P and the suction zone 38 in order to regulate the amount of vacuum which reaches the suction zone 38. A pressure gauge PG is positioned in the area of the suction zone 38 in order to measure a pressure in the suction zone 38. Each of the valve V and the pressure gauge PG is connected to a control unit. The control unit may utilize a set point SP and control instrumentation which functions as a pressure indicated and controlled PIC system. In operation, valve V is set to achieve a certain vacuum in the suction zone 38. The desired vacuum may be achieved, e.g., when the dryness of the tissue web is higher than approximately 8% and preferably higher than approximately 12%. Additionally, it is preferred that the dryness be determined and/or measured after the suction zone 38 in the web travel direction L. The dryness may be measured by various dryness measuring devices such as a radioactive gauge or the like. The dashed line indicates an optional control circuit for the vacuum in the suction zone 38.

Figure 9:
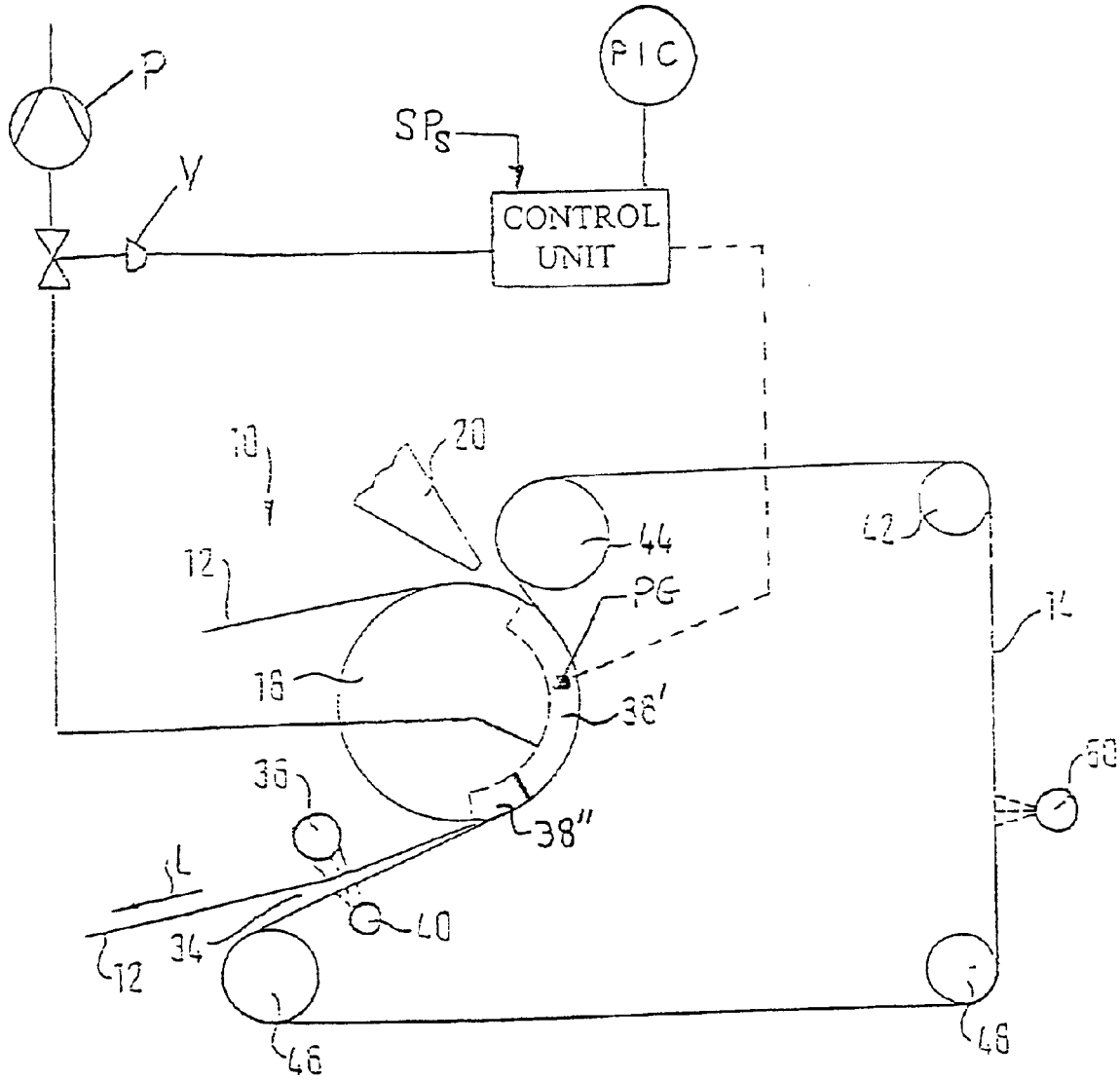
FIG. 9 shows an enlarged representation of the forming zone of the former depicted in FIG. 1 and illustrates another embodiment of how the vacuum to a two zone suction zone is regulated or controlled.

FIG. 9 shows an enlarged representation of the forming zone of the former depicted in FIG. 1 and illustrates another embodiment of how the vacuum to a two zone suction zone is regulated or controlled.

The former utilizes regulated, controlled and/or adjustable vacuum to a two zone suction zone 38' and 38" which is positioned inside the loop of inner belt 12, in the area of forming roll 18. Suction zone is divided into a first suction zone 38' and a second suction zone 38". A vacuum device P which may be a vacuum pump or an exhaust fan or similar vacuum source is connected to suction zone 38 to supply vacuum thereto. A valve V which may be a throttling device or a butterfly valve or the like is position in between the vacuum device P and the suction zone 38 in order to regulate the amount of vacuum which reaches the suction zone 38. A pressure gauge PG is positioned in the area of the suction zone 38 in order to measure a pressure in the suction zone 38. Each of the valve V and the pressure gauge PG is connected to a control unit. The control unit may utilize a set point $SP_S$ and control instrumentation which functions as a pressure indicated and controlled PIC system. In operation, the vacuum in first suction zone 38' may be related and/or determined based upon the dewatering behavior of the web. In second suction zone 38", the vacuum may be related and/or determined based upon the separation behavior of the web from wire 14. In this regard, the stronger the web attaches to the wire 14 at separation 34, the higher the vacuum in zone 38" is adjusted to be in order to improve the ability of the web to detach from wire 14. As in the embodiment of FIG. 8, valve V may be set to achieve a certain vacuum in each zone 38' and 38". The desired vacuum may be achieved, e.g., when the dryness of the tissue web is higher than approximately 8% and preferably higher than approximately 12%. Additionally, it is preferred that the dryness be determined and/or measured after suction zone 38' or suction zone 38" in the web travel direction L. The dryness may be measured by various dryness measuring devices such as a radioactive gage or the like. The system may also include devices for determining dewatering behavior of the web such as a camera. The dashed line indicates an optional control circuit for the vacuum in either or both suction zones 38' and 38".

Figure 10:
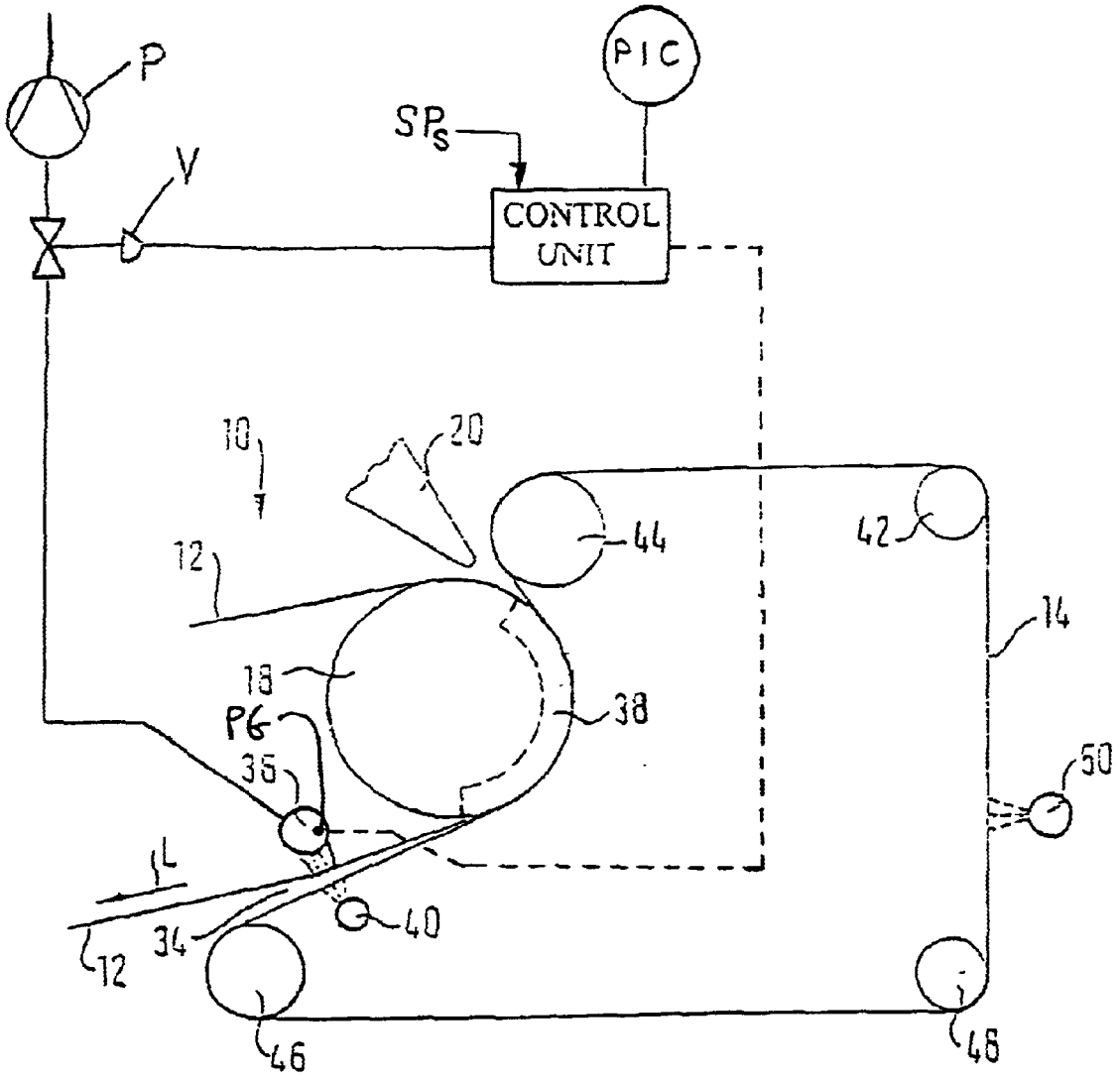
FIG. 10 shows an enlarged representation of the forming zone of the former depicted in FIG. 1 and illustrates still another embodiment of how the vacuum to the suction device is regulated or controlled.

FIG. 10 shows an enlarged representation of the forming zone of the former depicted in FIG. 1 and illustrates still another embodiment of how the vacuum to the suction device is regulated or controlled.

The former utilizes regulated, controlled and/or adjustable vacuum to suction device 36 which is positioned inside the loop of inner belt 12, in the area of separation point 34. A vacuum device P which may be a vacuum pump or an exhaust fan or similar vacuum source is connected to suction zone 38 to supply vacuum thereto. A valve V which may be a throttling device or a butterfly valve or the like is position in between the vacuum device P and the suction device 36 in order to regulate the amount of vacuum which reaches suction device 36. A pressure gauge PG is positioned in the area of suction device 36 and separation point 34 in order to measure a pressure at suction device 36. Each of the valve V and the pressure gauge PG is connected to a control unit. The control unit may utilize a set point $SP_S$ and control instrumentation which functions as a pressure indicated and controlled PIC system. In operation, valve V is set to achieve a certain vacuum in suction device 36. The desired vacuum may be achieved, e.g., when the dryness of the tissue web is higher than approximately 8% and preferably higher than approximately 12%. Additionally, it is preferred that the dryness be determined and/or measured after the suction zone 38 in the web travel direction L. The dryness may be measured by various dryness measuring devices such as a radioactive gage or the like. Also, vacuum in suction device 36 may relate or be determined by the release behavior of the web from wire 14 as described above in FIG. 9. Moreover, set point $SP_S$ may be set by hand or automatically depending on the release behavior. Accordingly, if the web or a portion of the web, e.g., the edges of the web, is not detached safely from wire 14, the vacuum in suction device 36 may be increased. Such a design allows the web to be separated more safely so that the sheet run is stabilized, e.g., so that the edges of the web do not flutter. Thus, the complete web is in stable contact with wire 12. As in the other embodiments, the dashed line indicates an optional control circuit for the vacuum in the suction device 36.

In should be noted that the vacuum control systems shown in FIGS. 8–10 may be combined into one complete system so that the vacuum in each of suction zone 38 and suction device 36 can be controlled and/or adjusted together. Various dryness measurement devices, separation detection devices, and other devices for determining dewatering behavior may also be included.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Crescent former
12 Inner belt
14 Outer belt
16 Stock inlet nip
18 Forming roll
20 Headbox
22 Tissue web
24 Elongated press nip
26 Yankee cylinder
28 Shoe press roll
30 Suction roll
32 Drying cover
34 Separation point
36 Suction element
38 Suction zone
40 Blowing element
42 Guiding roll
44 Guiding roll
46 Guiding roll
48 Guiding roll
50 Conditioning device
52 Roll
54 Scraper
56 Spray pipe
58 Accepting device
60 Jet arrangement
62 Suction device
64 Spray pipe
66 Inlet wedge
68 Cleaning jet
70 Jet head
72 Suction cup
74 Suction pipe
76 Suction area
78 High pressure pipe
80 High pressure water jet
82 Traverse wagon
84 Lateral carrier
86 Grid
88 Areas
L Web travel direction
S Wire travel direction
P Vacuum source
V Valve
PIC Pressure indicated or controlled
SP Set point
$SP_S$ Set point
PG Pressure gauge

What is claimed is:

1. A former for producing a tissue web, comprising:

a forming element comprising a forming roll, an inner dewatering belt, and an outer dewatering belt;

the inner and outer belts converging to form a stock inlet nip;

at least one of the inner and outer belts being a dewatering belt having zonally variable wire permeability;

the inner and outer belts being guided by the forming roll and thereafter separating from one another in the area of a separation point;

at least one suction element positioned adjacent the inner belt on a side which is opposite the outer belt; and the at least one suction element being positioned at least one of:

within the forming roll; and adjacent the area of the separation point, wherein the inner and outer belts separate from each other immediately following the forming roll.

2. The former of claim 1, wherein at least the outer belt is a dewatering wire having zonally variable wire permeability.

3. The former of claim 1, wherein the tissue web is separated from the outer belt in the area of the separation point.

4. The former of claim 3, wherein the tissue web is retained by the inner wire after being separated from the outer belt.

5. The former of claim 1, wherein at least one of the inner and outer belts comprises a circulating continuous dewatering belt.

6. The former of claim 1, wherein each of the inner and outer belts is a circulating continuous dewatering wire having zonally variable wire permeability.

7. The former of claim 1, wherein the inner belt contacts the forming element and the outer belt is guided with the inner belt around the forming element such that the outer belt does not come into contact with the forming element.

8. The former of claim 1, wherein the forming element comprises the at least one suction element.

9. The former of claim 8, wherein the forming element comprises a suction zone.

10. The former of claim 1, wherein the at least one suction element is positioned adjacent the area of the separation point.

11. The former of claim 10, wherein the at least one suction element is provided inside a loop of the inner belt.

12. The former of claim 1, wherein the at least one suction element comprises a vacuum suction element and wherein the vacuum present inside the suction element is adjustable.

13. The former of claim 1, wherein the at least one suction element is positioned in front of the separation point, in a web travel direction.

14. The former of claim 1, wherein the at least one suction element causes the inner belt to separate from the outer belt.

15. The former of claim 1, wherein the at least one suction element is arranged at least essentially over an entire width of one of the inner belt and the tissue web.

16. The former of claim 1, further comprising at least one blowing element positioned adjacent the outer belt on a side which is opposite the inner belt.

17. The former of claim 16, wherein the at least one blowing element is located in the area of the separation point.

18. The former of claim 16, wherein the at least one blowing element is located in the area of the separation point and inside a loop of the outer belt.

19. The former of claim 16, wherein the at least one blowing element is arranged at least essentially over an entire width of one of the outer belt and the tissue web.

20. The former of claim 1, wherein the forming element comprises a suction zone having adjustable vacuum.

21. A former for producing a tissue web, comprising:

a forming element comprising a forming roll, an inner dewatering belt, and an outer dewatering belt;

the inner and outer belts converging to form a stock inlet nip;

at least one of the inner and outer belts being a dewatering belt having zonally variable wire permeability;

the inner and outer belts being guided by the forming roll and thereafter separating from one another in the area of a separation point;

a conditioning device positioned adjacent the outer belt; and at least one suction element being positioned at least one of:

within the forming roll; and adjacent the area of the separation point, wherein the inner and outer belts separate from each other immediately following the forming roll.

22. The former of claim 21, wherein the at least one suction element is positioned adjacent the inner belt on a side which is opposite the outer belt.

23. The former of claim 21, wherein the tissue web is separated from the outer belt in the area of the separation point.

24. The former of claim 23, wherein the tissue web is retained by the inner wire after being separated from the outer belt.

25. The former of claim 21, wherein at least one of the inner and outer belts comprises a circulating continuous dewatering belt.

26. The former of claim 21, wherein each of the inner and outer belts is a circulating continuous dewatering wire having zonally variable wire permeability.

27. The former of claim 21, wherein the inner belt contacts the forming element and the outer belt is guided with the inner belt around the forming element such that the outer belt does not come into contact with the forming element.

28. The former of claim 21, wherein the forming element comprises the at least one suction element.

29. The former of claim 28, wherein the forming element comprises a suction zone.

30. The former of claim 21, wherein the at least one suction element is positioned adjacent the area of the separation point.

31. The former of claim 30, wherein the at least one suction element is provided inside a loop of the inner belt.

32. The former of claim 30, wherein the at least one suction element comprises a vacuum suction element and wherein the vacuum present inside the suction element is adjustable.

33. The former of claim 30, wherein the at least one suction element is positioned in front of the separation point, in a web travel direction.

34. The former of claim 30, wherein the at least one suction element causes the inner belt to separate from the outer belt.

35. The former of claim 30, wherein the at least one suction element is arranged at least essentially over an entire width of one of the inner belt and the tissue web.

36. The former of claim 21, further comprising at least one blowing element positioned adjacent the outer belt on a side which is opposite the inner belt.

37. The former of claim 36, wherein the at least one blowing element is located in the area of the separation point.

38. The former of claim 36, wherein the at least one blowing element is located in the area of the separation point and inside a loop of the outer belt.

39. The former of claim 36, wherein the at least one blowing element is arranged at least essentially over an entire width of one of the outer belt and the tissue web.

40. The former of claim 21, wherein the forming element comprises a suction zone having adjustable vacuum.

41. The former of claim 21, wherein the conditioning device comprises a wire cleaning device.

42. The former of claim 41, wherein the conditioning device is arranged at least essentially over an entire width of one of the outer belt and the tissue web.

43. The former of claim 41, wherein the inner belt is a felt belt.

44. The former of claim 21, wherein the former is a crescent former.

45. A former for producing a tissue web, comprising:

a forming roll, an inner continuous dewatering belt, and an outer continuous dewatering belt;

the inner and outer belts converging to form a stock inlet nip;

a headbox positioned adjacent the stock inlet nip;

each of the inner and outer belts forming corresponding inner and outer continuous loops which are each guided over a plurality of guide rolls;

each of the inner and outer belts being guided over the forming roll and thereafter separating from one another in the area of a separation point located immediately following the forming roll; and at least one of:

at least one suction element positioned inside the inner loop and adjacent the inner belt on a side which is opposite the outer belt; and a conditioning device positioned adjacent the outer belt so as to clean the outer belt, wherein at least one of the inner and the outer belts is a dewatering wire having zonally variable wire permeability.

46. The former of claim 45, further comprising:

a press nip through which the tissue web and the inner belt is guided, the press nip being formed between a cylinder and shoe press roll, wherein the tissue web is removed from the inner belt after passing through the press nip.

* * * * *